US005240434A

United States Patent [19]

Yagi et al.

[11] Patent Number: 5,240,434

[45] Date of Patent: Aug. 31, 1993

[54] CONNECTOR

[75] Inventors: Sakai Yagi; Motohisa Kashiyama, both of Shizuoka, Japan

[73] Assignee: Yazaki Corporation, Tokyo, Japan

[21] Appl. No.: 945,613

[22] Filed: Sep. 16, 1992

[30] Foreign Application Priority Data

Sep. 26, 1991 [JP] Japan ..... 3-77977[U]

[51] Int. Cl.[5] ..... H01R 13/40

[52] U.S. Cl. ..... 439/595; 439/594

[58] Field of Search ..... 439/594, 595, 597, 603

[56] References Cited

U.S. PATENT DOCUMENTS

| | | | |
|---|---|---|---|
| 4,127,314 | 11/1978 | Hasimoto | 439/595 |
| 4,557,542 | 12/1985 | Coller et al. | 439/595 |
| 4,664,460 | 5/1987 | Vandame | 439/595 |
| 4,732,437 | 3/1988 | Vandame | 439/595 |
| 4,902,247 | 2/1990 | Suzuki et al. | 439/595 |
| 4,944,688 | 7/1990 | Lundergan | 439/595 |
| 4,969,841 | 11/1990 | Sueyoshi et al. | 439/595 |
| 5,044,972 | 9/1991 | Ikeda | 439/595 |
| 5,057,040 | 10/1991 | Kodama et al. | 439/595 |
| 5,083,944 | 1/1992 | Pitts | 439/595 |
| 5,120,234 | 6/1992 | Mergless | 439/595 |

FOREIGN PATENT DOCUMENTS 58-134881 9/1983 Japan .

*Primary Examiner*—Paula A. Bradley

*Attorney, Agent, or Firm*—Sughrue, Mion, Zinn, Macpeak & Seas

[57] ABSTRACT

An object of the present invention resides in providing a connector which assures that clearance between an engagement projection of a flexible engagement piece projecting from the inner wall of each terminal accommodating chamber of a connector housing and an engagement hole of a terminal is minimized, and moreover, each terminal is properly inserted into the corresponding terminal accommodating chamber with a higher intensity of engaging force. According to the present invention, a connector includes a plurality of terminals each of which one end serves as an electrical contact portion having an engagement hole formed on a base plate and of which other end serves as a cable connecting portion. In addition, the connector includes a connector housing having a plurality of terminal accommodating chambers formed therein. A flexible engagement piece having an engagement projection formed at the foremost end thereof is projected from each terminal accommodating chamber, and the engagement projection serves as engaging means for allowing the engagement hole of the terminal to be engaged with the engagement projection. An upper surface is formed on the engagement projection while slantwise downwardly extending toward the cable connecting portion of the terminal. In addition, tapered portions are formed along ridge lines where the upper surface intersects both side surfaces.

2 Claims, 4 Drawing Sheets

CONNECTOR

BACKGROUND OF THE INVENTION

The present invention relates to construction of a connector by way of which opponent cables are connected to each other.

FIG. 5 is a vertical sectional view of a conventional connector a. As shown in FIG. 5, the connector a includes a plurality of terminals b each of which one end serves as a cable connecting portion $b_1$ and of which other end serves as an electrical contact portion $b_2$, and an engagement hole $b_3$ is formed on a base plate $b_2$, of the electrical contact portion $b_2$. In addition, the connector a includes a connector housing c having a plurality of terminal accommodating chambers $c_1$ formed therein with a flexible engagement piece d projected from the inner wall surface of each terminal accommodating chamber $c_1$. An engagement projection $d_1$ is formed at the foremost end part of the flexible engagement piece d to serve as engaging means for allowing it to be engaged with the engagement hole $b_3$ of the terminal b.

A guide projection $d_2$ having a small width is formed on the engagement projection $d_1$ of the flexible engagement piece d while extending toward the electrical connecting portion $b_1$ of the terminal b (Unexamined Japanease Utility Model Publicatin No. 58-134881).

Since the conventional connector is constructed in the above-described manner, it is necessary that a width $m_1$ of the terminal accommodating chamber $c_1$ is set to a dimension having some clearance $t_1$ added to a width $m_2$ of the terminal b. Since the terminal b is disposed in the center of the terminal accommodating chamber $c_1$, the clearance on each side of the terminal b is $t_1/2$. In addition, it is necessary that a width $m_3$ of the engagement hole $b_3$ is set to a dimension having some clearance $t_2$ added to a width $m_4$ of the engagement projection $d_1$. Since the projection is centrally disposed in the engagement hole $b_3$, the clearance on each side of the projection $d_1$ is $t_2/2$.

Further, when the terminal b is inserted into the terminal accommodating chamber $c_1$ with leftward or rightward positional offset, the engagement projection $d_1$ fails to be correctly fitted into the engagement hole $b_3$ of the terminal b unless the clearance $t_2$ is dimensioned to be slightly larger than the clearance $t_1$. Consequently, the terminal b can not be connected to the connector housing c via the flexible engagement piece d.

Thus, the width $m_4$ of the engagement projection $d_1$ on the flexible engagement piece d is dimensioned to be smaller than the width $m_3$ of the engagement hole $b_3$ on the terminal b by a quantity corresponding to the clearance $t_2$. For this reason, there arises a malfunction of so-called shaking movement of the terminal b in the leftward/rightward direction by the quantity corresponding to the clearance $t_2$, and moreover, there arises another malfunction that a magnitude of engaging force effective for the terminal b is undesirably reduced. In addition, when an abnormal magnitude of drawing-out force is exerted on the terminal b, there is a possibility that the engagement projection $d_1$ shears away from the flexible engagement piece d.

SUMMARY OF THE INVENTION

The present invention has been made in consideration of the foregoing background and its object resides in providing a connector which assures that clearance between an engagement projection of a flexible engagement piece projected from the inner wall of each terminal accommodating chamber of a connector housing and an engagement hole formed on each terminal is minimized while maintaining a higher intensity of engaging force for the terminal.

To accomplish the above object, the present invention provides a connector including a plurality of terminals each of which one end serves as an electrical contact portion having an engagement hole formed on a base plate thereof and of which other end serves as a cable connecting portion and a connector housing having a plurality of terminal accommodating chambers formed therein with a flexible engagement piece projected from the inner wall of each terminal accommodating chamber so as to allow the flexible engagement piece to be engaged with the engagement hole of the terminal, wherein tapered portions are formed along ridge lines where the upper surface of the flexible engagement piece intersect both side surfaces of the engagement projection.

With the connector constructed in the above-described manner, the tapered portions are formed along the ridge lines where the upper surface of the engagement projection on the flexible engagement piece projected from the inner wall of each terminal accommodating chamber of the connector housing intersects both side surfaces of the engagement projection. Thus, when each terminal is inserted into the corresponding terminal accommodating chamber and the engagement projection of the flexible engagement piece is then engaged with the engagement hole of the terminal, the tapered portions on both the side surfaces of the engagement projection on the flexible engagement piece can properly guide slidable movement of the terminal while the clearance between the engagement projection and the engagement hole of the terminal is minimized.

DETAILED DESCRIPTION OF THE PREFERRED EMBODIMENTS

Figure 1:
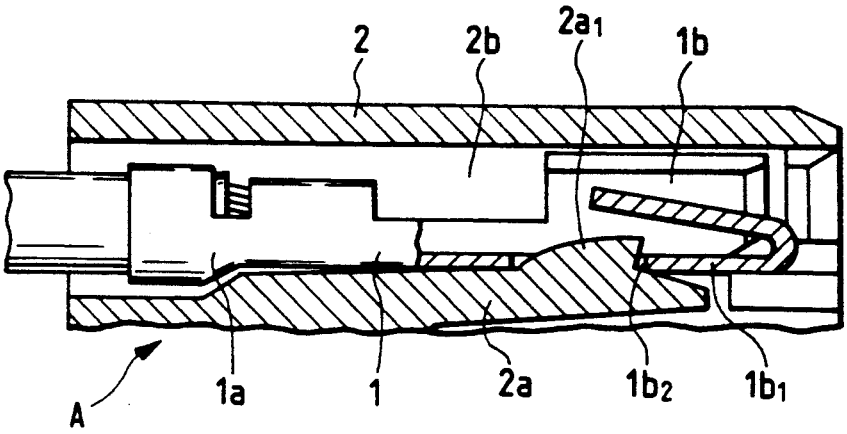
FIG. 1 is a vertical sectional view of a connector in accordance with an embodiment of the present invention.

FIG. 1 is a vertical sectional view of a connector A in accordance with an embodiment of the present invention.

As shown in FIG. 1, the connector A includes a plurality of terminals 1 each of which one end serves as an electric contact portion 1*b* having an engagement hole $1b_2$ formed on a base plate $1b_1$ of each terminal 1 and of which other end serves as an electrical connecting portion 1*a*. In addition, the connector A includes a connector housing 2 having a plurality of terminal accommodating chambers 2*b* formed therein.

A flexible engagement piece 2*a* having an engagement projection $2a_1$ formed at the foremost end part thereof is projected from the inner wall of each terminal accommodating chamber 2*b*. When the engagement projection $2a_1$ of the flexible engagement piece 2*a* is engaged with the engagement hole $1b_2$ of the terminal 1, disconnection of the terminal 1 from the connector housing 2 is reliably prevented.

Figure 2A:
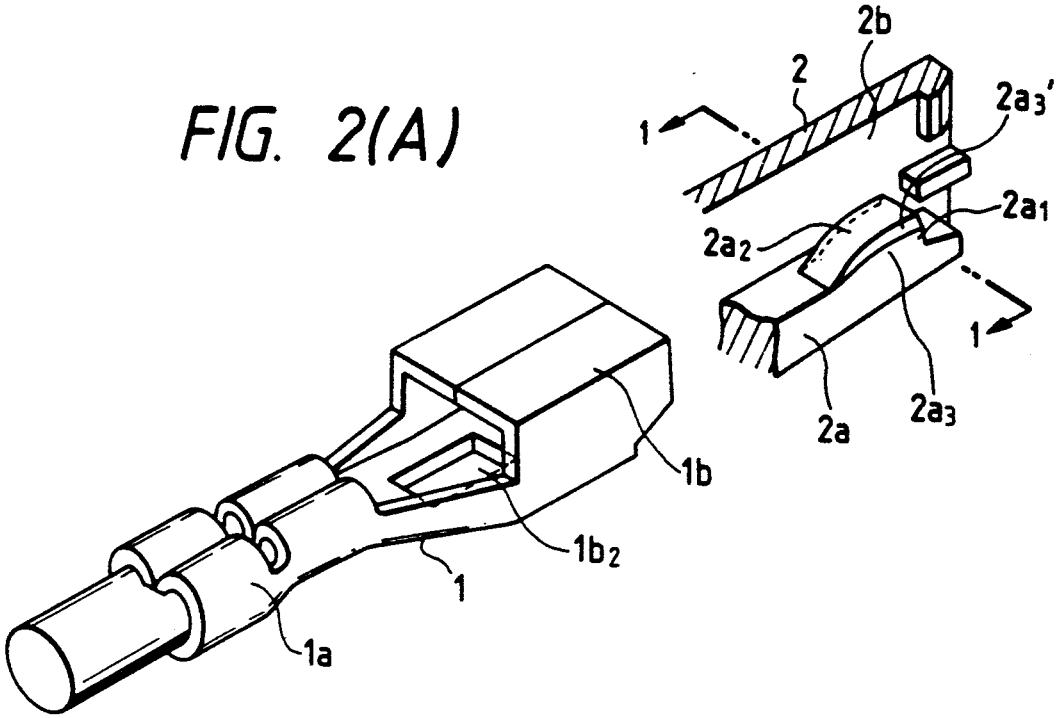
FIG. 2(A) is a perspective view of the connector shown in FIG. 1, particularly illustrating essential components constituting the connector in the disassembled state.

Referring to FIG. 2(A), an upper surface $2a_2$ is formed on engagement projection $2a_1$ of the flexible engagement piece 2*a* while slantwise downwardly extending toward the cable connecting portion 1*a* of the terminal 1, and a pair of tapered portions $2a_3'$ are formed along ridge lines where the upper surface $2a_2$ intersects both side surfaces $2a_3$.

Figure 2B:
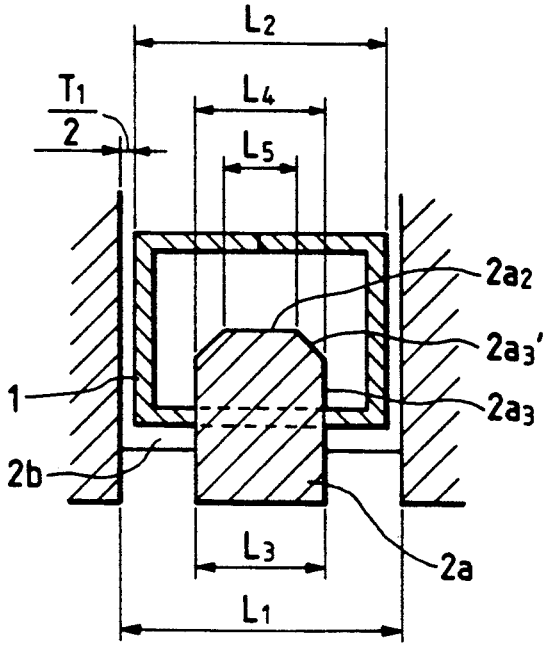
FIG. 2(B) is a cross-sectional view of the connector taken along line 1—1 in FIG. 2(A)

Referring to FIG. 2(B), a width $L_1$ of the terminal accommodating chamber 2*b* is set to a dimension having some clearance $T_1$ added to a width $L_2$ of the terminal 1, and a width $L_3$ of the engagement hole $1b_2$ is set to a dimension substantially equal to a width $L_4$ of the engagement projection $2a_1$.

Figure 3:
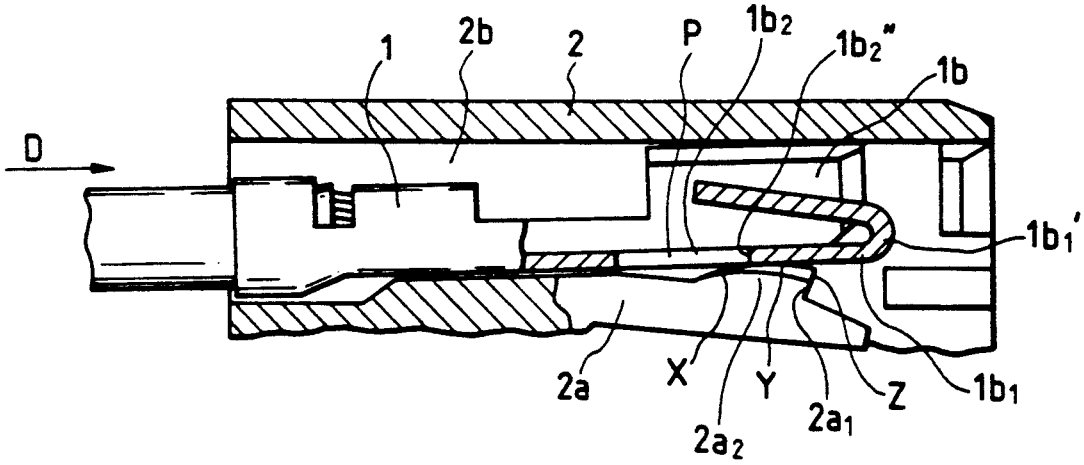
FIG. 3 is a vertical sectional view of the connector, particularly illustrating a step of inserting a terminal into a connector housing.

Since the connector of the present invention is constructed in the above-described manner, when it is practically used, the terminal 1 is inserted into the corresponding terminal accommodating chamber 2*d* in the D arrow-marked direction with the electrical contact portion 1*b* located ahead as shown in FIG. 3.

At this time, the format end $1b_1'$ of the base plate $1b_1$ of the electrical contact portion 1*b* slidably moves along the upper surface $2a_2$ of the engagement projection $2a_1$ on the flexible engagement piece 2*a*, whereby the terminal 1 is inserted into the terminal accommodating chamber 2*b* while depressing the flexible engagement piece 2*a*.

Figure 4A:
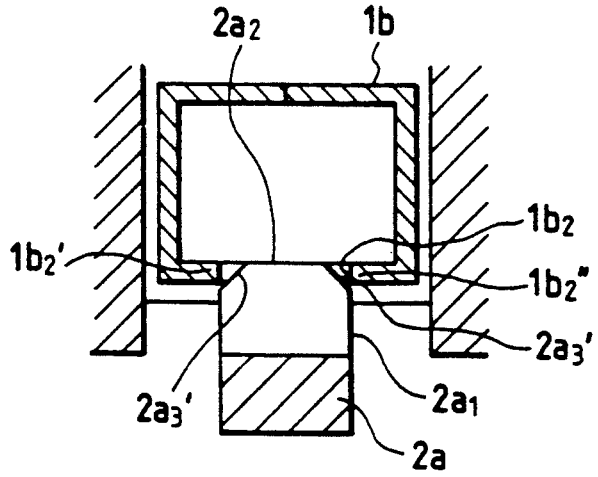
FIG. 4(A), FIG. 4(B) and FIG. 4(C) are cross-sectional views of the connector, particularly illustrating the operative state that the terminal is engaged with a flexible engagement piece during the step of inserting the terminal into the connector housing in accordance with the embodiment of the present invention, respectively.

When an intermediate point P on the engagement hole $1b_2$ formed on the base plate $1b_1$ of the electrical contact portion 1*b* is positionally aligned with a point X at the lower end of the slantwise extending surface of the upper surface $2a_2$ of the engagement projection $2a_1$ on the flexible engagement piece 2*a* as the terminal 1 is inserted in that way, the lowermost ends of the tapered portions $2a_3'$ on the engagement projection $2a_1$ are brought in slidable contact with both side edges $1b_2'$ of the engagement hole $1b_2$, as shown in FIG. 4(A). Thus, even when the center axis of the terminal 1 is positionally offset from the center axis of the engagement projection $2a_1$ in the transverse direction, the tapered portion $2a_3'$ located on the offset side slidably moves along the side edge $1b_2'$ located on the offset side, causing a component effective for correcting the aforementioned transversely offset state to be generated. As a result, the engagement projection $2a_1$ is automatically brought in engagement with the engagement hole $1b_2$ by the self-alignment function derived from the foregoing component.

Figure 4B:
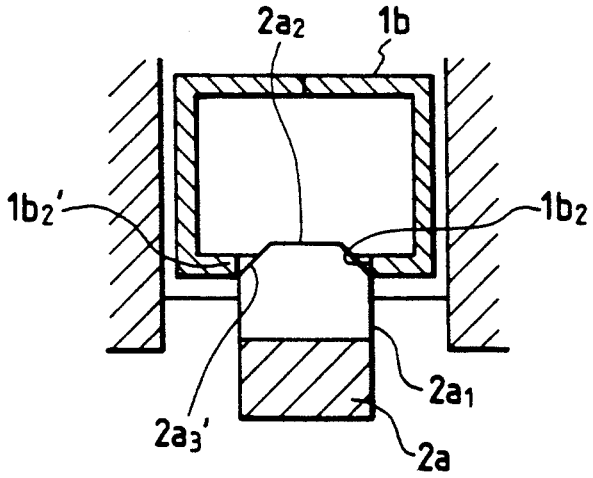

Next, when the intermediate point P on the engagement hole $1b_2$ of the terminal 1 is located at a central point Y on the upper surface $2a_2$ of the engagement projection $2a_1$ on the flexible engagement piece 2*a*, the lower end parts of the tapered portions $2a_3'$ on the engagement projection $2a_1$ are located correctly along the side edges $1b_2'$ of the engagement hole $1b_2$ on the terminal 1, causing the engagement projection $2a_1$ to be more firmly engaged with the engagement hole $1b_2$, as shown in FIG. 4(B).

Figure 4C:
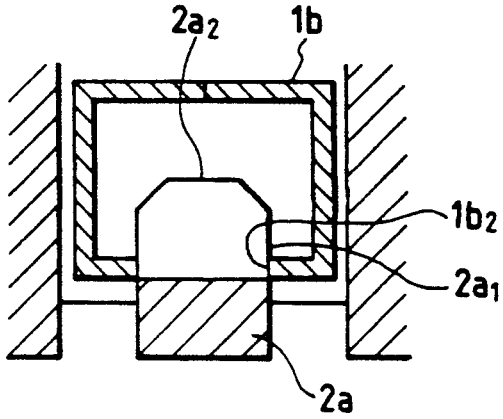
Figure 5:
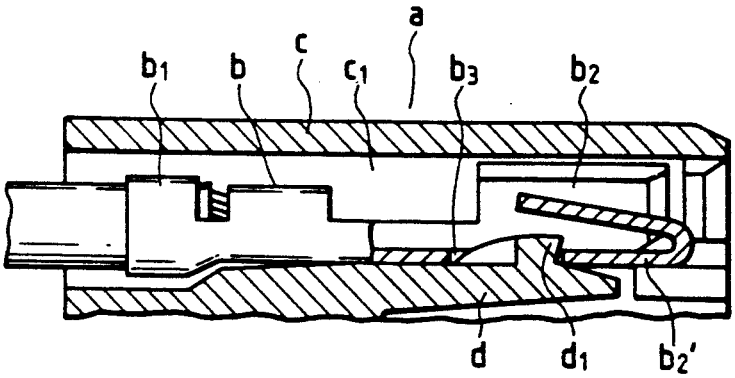
FIG. 5 PRIOR ART
FIG. 5 is a vertical sectional view of a conventional connector.
Figure 6:
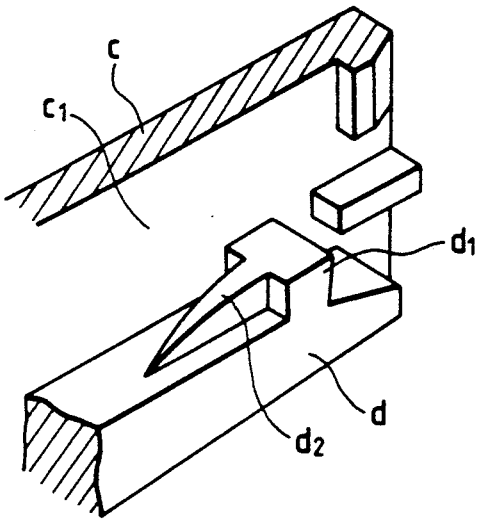
FIG. 6 PRIOR ART
FIG. 6 is a fragmentary perspective view of the conventional connector, particularly illustrating essential components constituting the conventional connector in the exploded state.
Figure 7:
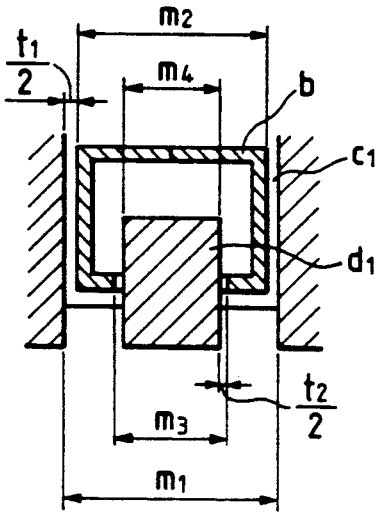
FIG. 7 PRIOR ART
FIG. 7 is a cross-sectional view of the conventional connector, particularly illustrating the operative state that an engagement hole of a terminal is engaged with a flexible engagement piece formed on a base plate of a connector housing.

Next, when the foremost end edge $1b_2''$ of the engagement hole $1b_2$ on the terminal 1 reaches an end plane Z of the engagement projection $2a_1$ on the flexible engagement piece 2*a*, the engagement projection $2a_1$ on the flexible engagement piece 2*a* is completely engaged with the engagement hole $1b_2$ on the terminal 1 while the end plane Z of the former is correctly aligned with the foremost end edge $1b_2''$ of the latter, as shown in FIG. 4(C).

In other words, although the width $L_3$ of the engagement hole $1b_2$ is set to a dimension substantially equal to the width $L_4$ of the engagement projection $2a_1$, since the tapered portions $2a_2$ are formed along the ridge lines of the upper surface $2a_3$ of the engagement projection $2a_1$ on the flexible engagement piece 2*a*, the engagement projection $2a_1$ is smoothly brought into the engagement hole $1b_2$ by the action of automatic self-alignment even when the center axis of the terminal 1 is slightly offset from the center axis of the engagement projection $2a_1$. Consequently, the terminal 1 is reliably engaged with the flexible engagement piece 2*a*.

Thus, the flexible engagement piece 2*a* can be dimensioned to be large by a quantity equal to the aforementioned clearance set to the flexible engagement piece of the conventional connector.

Since the connector is constructed in the above-described manner according to the present invention, the clearance between the engagement projection of the flexible engagement piece and the engagement hole of the terminal is minimized with the result that the extent of shaking movement of the head portion of the flexible engagement piece in the transverse direction can be minimized, and moreover, the terminal can more reliably be seized by the flexible engagement piece. Thus, advantageous effects of the present invention are that the terminal can be engaged with the opponent housing with a higher intensity of engaging force and the terminal can be inserted into the housing with increased reliability.

What is claimed is:

1. A connector comprising:

a connector housing;

a plurality of terminal accommodating chambers for receiving a terminal, said terminal accommodating chambers being formed in said connector housing, said terminal having a terminal electrical contact portion including an engagement hole formed on a base plate of said electrical contact portion;

a flexible engagement piece projected from an inner wall of each terminal accommodating chamber, said flexible engagement piece having an engagement projection, said engagement projection including tapered portions defined along ridge lines where an upper surface of said engagement projection on said flexible engagement piece intersects both side surfaces of said engagement projection, wherein said flexible engagement piece is engaged with said engagement hole of said terminal.

2. A connector as claimed in claim 1, wherein the width of said engagement hole is slightly wider than the width of said engagement projection.

* * * * *